US005913712A

United States Patent [19]

Molinar

[11] Patent Number: 5,913,712

[45] Date of Patent: Jun. 22, 1999

[54] SCRATCH REDUCTION IN SEMICONDUCTOR CIRCUIT FABRICATION USING CHEMICAL-MECHANICAL POLISHING

[75] Inventor: Hector Molinar, San Jose, Calif.

[73] Assignee: Cypress Semiconductor Corp., San Jose, Calif.

[21] Appl. No.: 08/816,390

[22] Filed: Mar. 12, 1997

Related U.S. Application Data

[63] Continuation of application No. 08/512,771, Aug. 9, 1995, abandoned.

[51] Int. Cl.[6] ..... B24B 7/00

[52] U.S. Cl. ..... 451/41; 451/57; 451/59; 451/285

[58] Field of Search ..... 451/41, 57, 283, 451/285, 287, 288, 59, 63

[56] References Cited

U.S. PATENT DOCUMENTS

| | | | |
|---|---|---|---|
| 3,504,457 | 4/1970 | Jacobsen et al. | 451/288 |
| 3,673,746 | 7/1972 | Highberg | 451/41 |
| 3,857,123 | 12/1974 | Walsh | 451/288 |
| 4,016,855 | 4/1977 | Mimata | 451/41 |
| 4,462,188 | 7/1984 | Payne | 451/41 |
| 4,588,421 | 5/1986 | Payne | 451/41 |
| 5,032,203 | 7/1991 | Doy et al. | 451/287 |
| 5,245,790 | 9/1993 | Jerbic | 51/121 |
| 5,302,233 | 4/1994 | Kim et al. | 451/41 |
| 5,320,706 | 6/1994 | Blackwell | 451/41 |
| 5,340,370 | 8/1994 | Cadien et al. | 51/308 |
| 5,435,772 | 7/1995 | Yu | 451/287 |
| 5,449,314 | 9/1995 | Meikle et al. | 451/41 |
| 5,486,265 | 1/1996 | Salugsugan | 156/636.1 |

OTHER PUBLICATIONS

Sivaram, Srinivasan et al., "Developments in Consumables Used in the Chemical Mechanical Polishing of Dielectrics," *International Conference on Solid State Devices & Materials*, Aug. 21, 1995, (2 pages).

Ali, Iqbal et al., "Chemical–mechanical polishing of interlayer dielectric: A review," *Solid State Technology*, pp. 63–64, 66, 68, Oct. 1994.

*Primary Examiner*—Eileen P. Morgan

*Attorney, Agent, or Firm*—Blakely Sokoloff Taylor & Zafman LLP

[57] ABSTRACT

A process for polishing a layer on a semiconductor wafer in which the incidence of undesirable scratches on the polished surface is reduced by using a multiple step polishing procedure. A relatively hard polishing pad is used first to planarize the wafer surface, using a chemically reactive and abrasive slurry. A second polishing step is then carried out on a relatively soft polishing pad, using a slurry to remove or reduce scratches introduced by polishing with the hard pad. A final polishing step is performed on the soft polishing pad using de-ionized water to remove particles from the surface of the wafer.

25 Claims, 4 Drawing Sheets

SCRATCH REDUCTION IN SEMICONDUCTOR CIRCUIT FABRICATION USING CHEMICAL-MECHANICAL POLISHING

This is a continuation of application Ser. No. 08/512,771, filed Aug. 9, 1995, now abandoned.

FIELD OF THE INVENTION

This invention relates to the production of semiconductor integrated circuits, and more specifically to a process for manufacturing integrated circuits in which scratches due to chemical-mechanical polishing are reduced.

BACKGROUND OF THE INVENTION

Modern ultra-large scale integrated (ULSI) circuits are constructed with up to several millions of active devices, such as transistors and capacitors, formed in a semiconductor substrate. Interconnections between the active devices are created by providing a plurality of conductive interconnection layers, such as polysilicon and metal, which are etched to form conductors for carrying signals between the various active devices. The individual interconnection layers are nominally electrically isolated from one another, and from the silicon substrate, by an insulative interlayer dielectric (ILD), such as silicon dioxide ($SiO_2$) produced by chemical vapor deposition (CVD). The conductive layers and interlayer dielectric are deposited on the silicon substrate wafer in succession, with each layer being, for example, of the order of 1 micron in thickness. The ILD conformably covers the underlying layer (e.g. a metal layer etched to form conductive interconnects) such that the upper surface of the ILD is characterized by a series of non-planar steps which correspond in height and width to the underlying interconnect lines.

These height variations in the upper surface of the ILD can have deleterious effects on the subsequent steps and layers applied in forming the integrated circuit. For example, a non-planar dielectric surface can interfere with the optical resolution of subsequent photolithographic processing steps. This can make the high resolution lines required for compact ULSI circuits difficult to produce. Additionally, if the height variations in the ILD surface are severe, there is a danger that insufficient metal coverage can occur at the step height variations in the subsequent conductor layer, which can result in open circuit flaws.

In order to combat these difficulties, various techniques have been developed in an attempt to better planarize the upper surface of the ILD. One approach, referred to as chemical-mechanical planarization or polishing (CMP), employs abrasive polishing to remove the surface height variations of the dielectric layer. According to this method the semiconductor wafer is pressed against a moving polishing surface that is wetted with a chemically reactive, abrasive slurry. Slurries are usually either basic or acidic and generally contain a suspension of alumina or silica particles. The polishing surface and wafer are moved relative to one another in an abrasive fashion to remove protruding portions of the dielectric layer. The abrasive polishing process continues until the surface of the ILD is largely flattened.

One problem which has been encountered with subjecting semiconductor wafers to chemical-mechanical polishing is that scratches can be produced on the polished surface of the wafer (e.g. on the surface of the ILD). Metal deposited on the ILD as the next layer of the integrated circuit fills these scratches, but can then be difficult to remove therefrom when forming the metal layer into the desired circuit interconnections. The resulting filaments of metal remaining in the CMP scratches after forming the interconnections can cause a short circuit fault to occur if the scratch is proximate to contacts or interconnection lines in the metal layer.

Thus, what is required is a chemical-mechanical polishing process in which scratches on the wafer surface are avoided or removed prior to deposition of a subsequent conductive layer.

SUMMARY OF THE INVENTION

In accordance with the present invention, there is provided a process for planarizing a layer formed on a wafer during fabrication of a semiconductor integrated circuit. A first polishing step of the process involves polishing the wafer on a first polishing pad using a slurry having a chemical reagent and a suspension of abrasive particles. The first polishing pad is a relatively hard pad (relatively low compressibility) and is used to abrade a surface portion of the layer so as to planarize the surface of the layer. A second polishing step of the process is then performed on a second polishing pad, also using a slurry. The second polishing pad is a relatively soft pad (relatively high compressibility), and is used to remove scratches from the planarized layer surface which may have resulted from the first polishing step. Finally, a third polishing step is performed on the wafer using the second polishing pad but de-ionized water instead of the abrasive slurry. The third polishing step removes the slurry solution and particles from the surface of the wafer.

In order to abrade the surface of the layer being planarized, the pressure used to apply the wafer to the first polishing pad is relatively high, and is preferably in the range of about 3.5 to about 9 pounds-per-square-inch (PSI). The scratch removal phase comprising the second polishing step involves less pressure between the wafer and the second polishing pad, in the range of about 2 to about 5 PSI. Finally, the rinsing stage comprising the third polishing step involves the least pressure, and is preferably of the order of 0.5 to 1.5 PSI.

Rotation of both the polishing pad and the wafer is employed for each of the polishing steps, with rotation speeds typically in the range of about 10 to 20 revolutions-per-minute (RPM) for the first and second polishing steps. The third polishing step is preferably carried out with higher rotational speeds, such as greater than 30 RPM for each of the polishing pad and the wafer. In the preferred embodiments the third polishing step involves rotational speeds of the order of 60 RPM which facilitates cleansing of the wafer of slurry and abraded particles with the aid of the supplied water.

The wafer is polished on the first polishing pad to remove a desired amount of material from the layer being polished, and the time required for polishing during the first polishing step is adjusted accordingly. For example, for many applications the first polishing step time will be in the range of about one minute to about four minutes. The second polishing step, used for removing or reducing scratches on the wafer, generally achieves better results with longer polishing times, although it has been found that a second polishing step time in the range of about 30 to 45 seconds can yield adequate results. It is preferred that the second polishing step be performed for at least 30 seconds. The third polishing step, which is primarily for removing particles from the wafer surface with water as a rinsing agent, can be performed for any suitable length of time, and one minute of this processing step has been found to generally be sufficient.

Other features and advantages of the present invention will be apparent from the appended claims, and from the detailed description of the invention which follows below.

BRIEF DESCRIPTION OF THE DRAWINGS

The invention is described in greater detail hereinafter, by way of example only, with reference to the accompanying drawings, wherein.

DETAILED DESCRIPTION OF PREFERRED EMBODIMENTS OF THE INVENTION

A novel chemical-mechanical polishing process for semiconductor integrated circuit formation is described. In the following description, numerous specific details are set forth, such as specific materials and process parameters, etc. in order to provide a thorough understanding of the present invention. It will be obvious, however, to one skilled in the art that the present invention may be practiced without these specific details. In other instances, well known semiconductor processes and machinery have not been described in particular detail in order to avoid unnecessarily obscuring the present invention.

In FIGS. 1 to 4, there is shown a cross-sectional representation of a potion of a semiconductor wafer at various stages of processing according to the prior art. These figures illustrate a difficulty which can arise when scratches are formed on the surface of an interlayer dielectric (ILD) by a chemical-mechanical polishing step.

Figure 1:
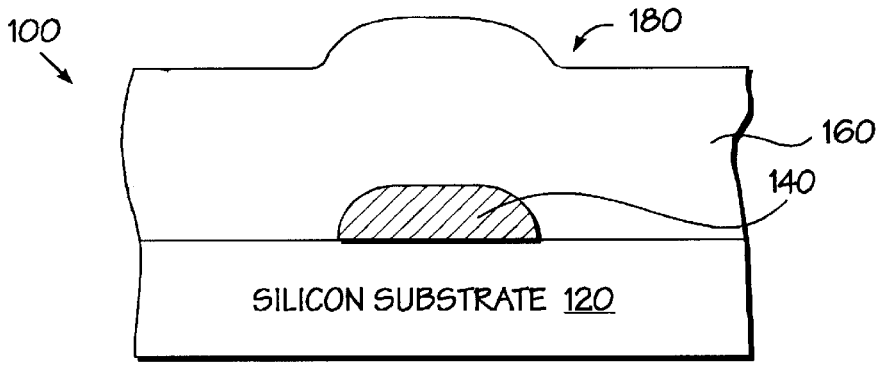
FIG.1 (PRIOR ART)
FIG. 1 is a cross-section of a portion of a conventional semiconductor substrate.

FIG. 1 shows a cross-section view of a portion of a semiconductor wafer 100 comprising a silicon substrate 120 having a polysilicon line 140 formed thereon. An insulating interlayer dielectric 160 is deposited over the silicon substrate 120 and polysilicon line 140. The conformal nature of the ILD 160 causes the surface 180 thereof to generally reflect the uneven topography of the underlying layers. The uneven surface 180 of the ILD 160 can have disadvantageous effects on the deposition, patterning and etching of subsequent layers. Consequently, a technique known as chemical-mechanical polishing (CMP) has been developed in order to planarize the surface of ILD 160 prior to subsequent processing. In general, chemical-mechanical polishing processes involve pressing the semiconductor wafer against a moving polishing surface that is wetted with a chemically reactive, abrasive slurry. Slurries are usually either basic or acidic and generally contain a suspension of alumina or silica particles as an abrasive agent. The polishing surface is typically a planar pad made of a porous material, such as blown poyurethane mounted on a planar rotatable platen.

Figure 2:
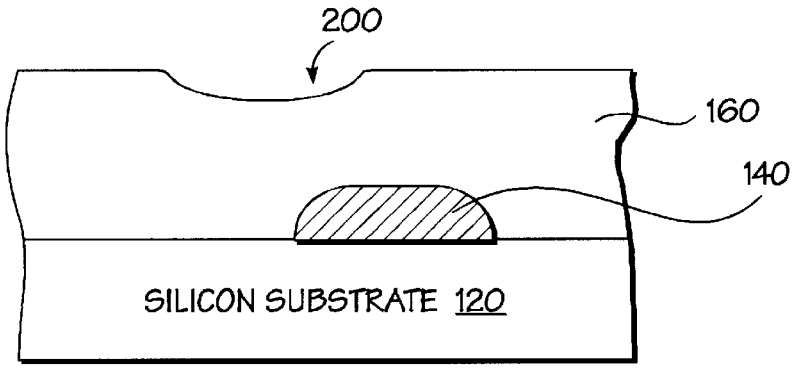
FIG.2 (PRIOR ART)
FIG. 2 is a cross-section of a conventional semiconductor substrate after CMP processing.

FIG. 2 illustrates a semiconductor wafer 100 following the CMP processing, wherein the surface features of the ILD 160 have been generally removed. A prior art polishing process may involve an initial polishing step on a relatively hard polishing pad (e.g. a polishing pad known by the name IC-60 manufactured by Rodel, Inc.) using an abrasive slurry in order to abrade the surface of the ILD to a generally planar state (FIG. 2). The initial polishing step may in some instances be followed by a rinsing or buffing step in order to remove particles from the surface of the wafer which may have adhered thereto during the planarizing step. The rinsing or buffing step may be performed using a CMP apparatus and a relatively soft polishing pad (such as a SUBA IV polishing pad from Rodel, Inc.) which is supplied with water while the wafer is applied thereto. However, in some instances the chemical-mechanical polishing process of the prior art can leave a scratch 200 in the surface of the polished layer, which can eventually result in a flawed semiconductor circuit as described herein below.

Figure 3:
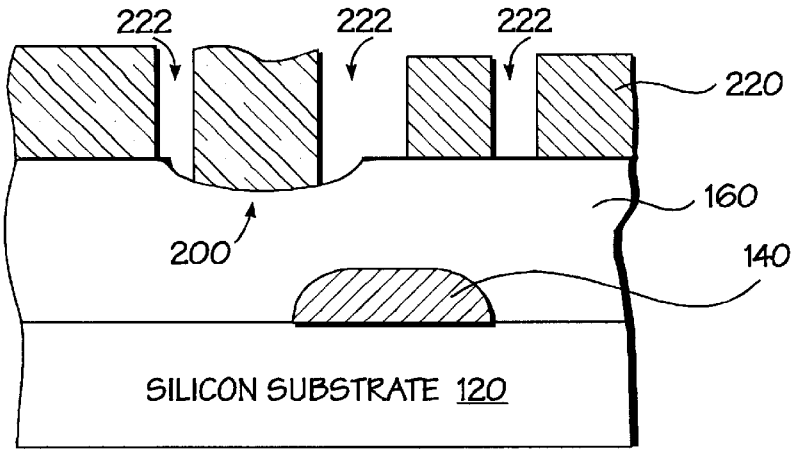
FIG.3 (PRIOR ART)
FIG. 3 is a cross-section of the semiconductor substrate illustrated in FIG. 2 after a photoresist layer has been deposited.
Figure 4:
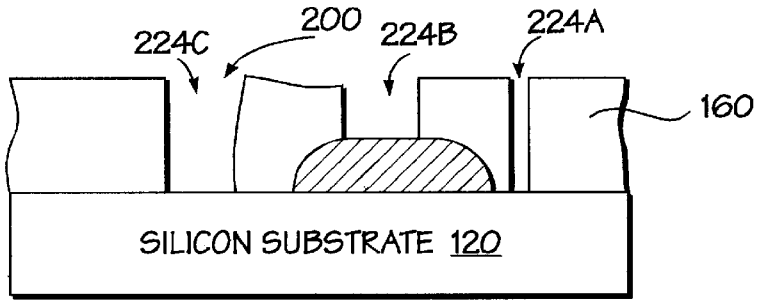
FIG.4 (PRIOR ART)
FIG. 4 is a cross-section of the semiconductor substrate of FIG. 3 after the formation of etched contact openings.
Figure 5:
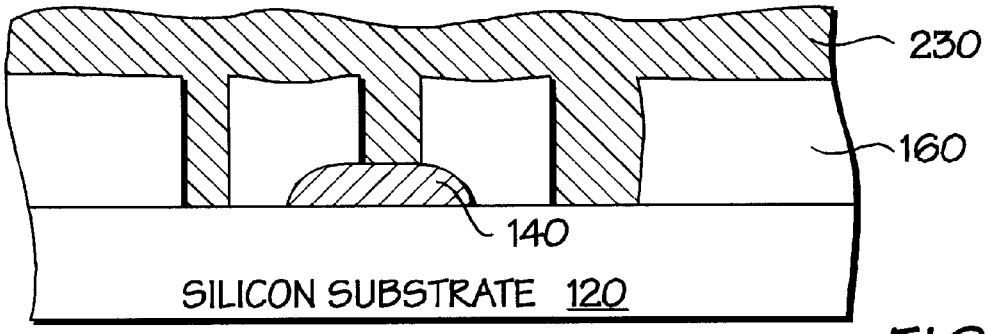
FIG. 5 (PRIOR ART)
FIG. 5 is a cross-section of the semiconductor substrate of FIG. 4 after a conductive material deposition.
Figure 6:
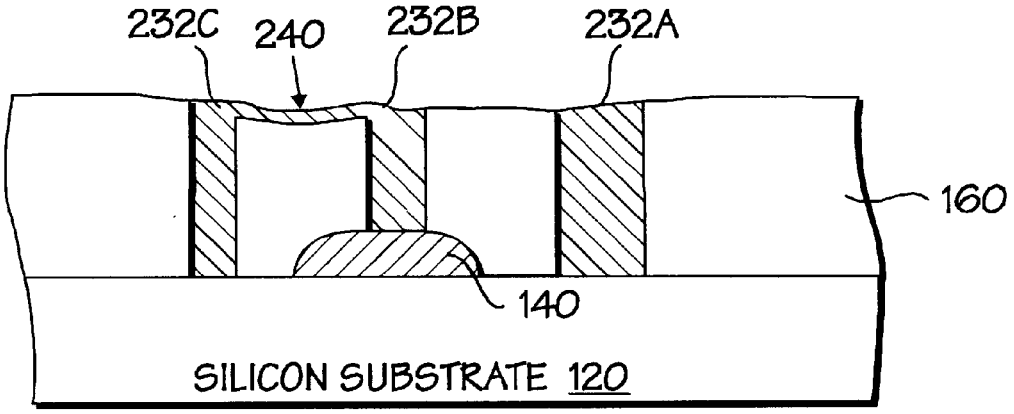
FIG. 6 (PRIOR ART)
FIG. 6 is a cross-section of the semiconductor substrate illustrated in FIG. 5 after the conductive material has been etched back.

The next step in the process involves depositing a photoresist layer 220, and patterning the layer with openings 222 for the formation of interlayer contacts to the silicon substrate 120 and polysilicon line 140 (FIG. 3). Etching of the ILD 160 is then performed according to the patterned photo-resist 220 using, for example, a conventional dry plasma etch process. This results in the formation of etched contact openings 224A, 224B and 22C, as illustrated in FIG. 4. In this example, the scratch 200 in the surface of the lLD 160 is in the region of adjacent contact openings 224B and 224C. A layer 230 of a conductive material such as tungsten is then deposited on the wafer, to fill the contact openings so as to create interlayer contacts. The conductive material 230 is then removed from the surface of the ILD 160 to leave plugs of conductive material 232A, 232B and 232C forming the interlayer contacts. The removal of the conductive material 230 is performed using an etching process or a polish-back process of chemical-mechanical polishing. However, as shown in FIG. 6, the depression in the surface of ILD 160 resulting from the scratch 200 can disadvantageously retain a portion of the conductive material on the surface of ILD 160, causing a conductive bridge 240 short-circuiting adjacent interlayer contacts 232B and 232C. This short circuit results in a flawed integrated circuit. Accordingly, it can be seen that scratches to a semiconductor wafer introduced during a chemical-mechanical polishing processing step can, in some circumstances, produce flawed integrated circuits, and thereby reduce the yield of a fabrication process.

Embodiments of the present invention can be utilized to reduce the difficulties associated with the prior art discussed above, by removing or reducing scratches introduced by a chemical-mechanical polishing step, or at least reducing the disadvantageous effects of the scratches on subsequent processing steps. This is achieved by a multi-stage polishing process, using more than one polishing pad.

Figure 7:
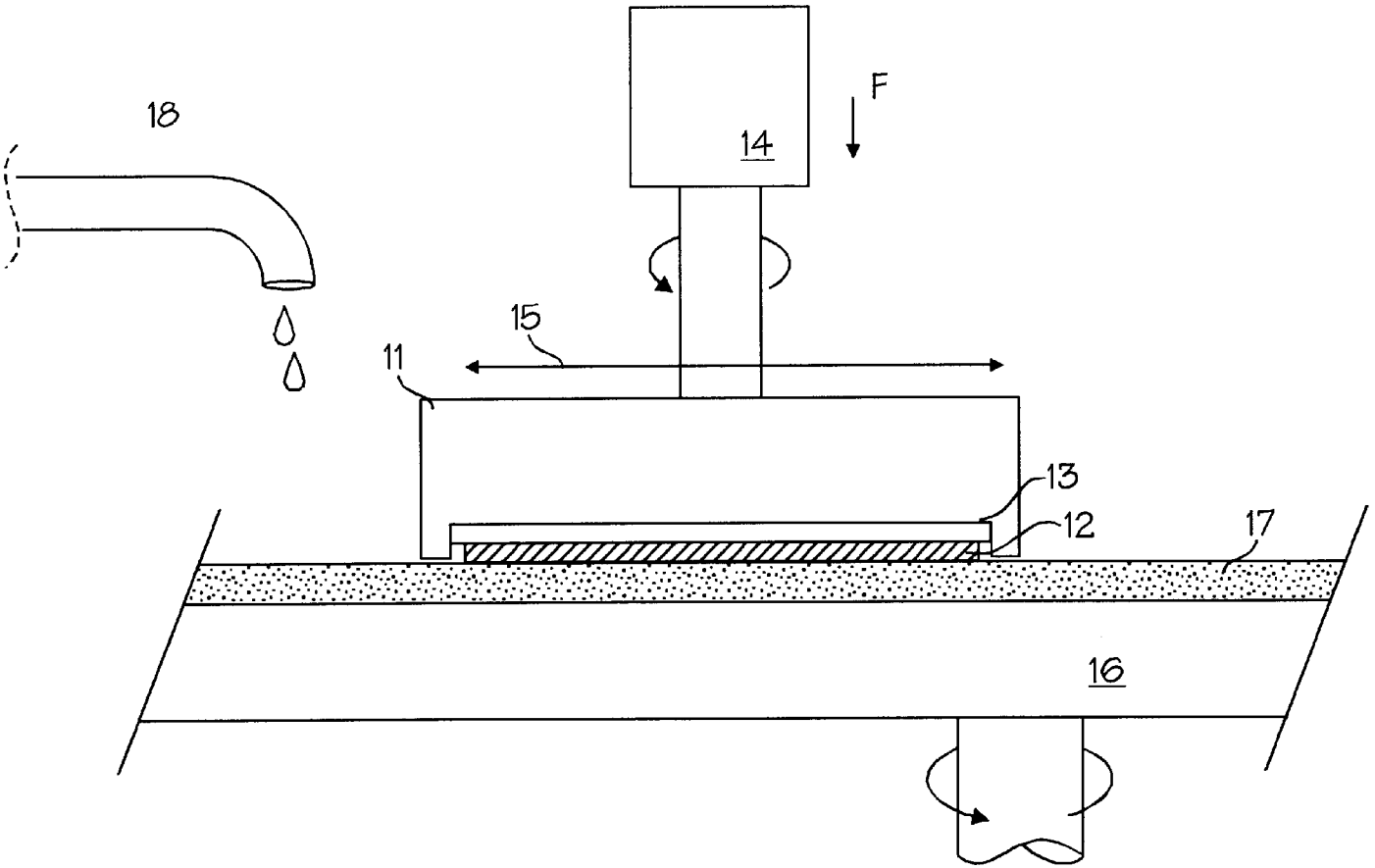
FIG. 7 (PRIOR ART)
FIG. 7 is a cut-away side view of a conventional chemical-mechanical polishing apparatus.

FIG. 7 depicts a conventional rotational chemical-mechanical polishing (CMP) apparatus which can be utilized in performing the present invention. The apparatus comprises a wafer carrier 11 for holding a semiconductor wafer 12. A soft, resilient pad 13 is typically placed between wafer carrier 11 and the safer 12, and the wafer is generally held against the resilient pad by a partial vacuum. The wafer carrier 11 and the wafer 12 is designed to be continuously rotated by a drive motor 14. In addition, the wafer carrier 11 is also designed for transverse movement as indicated by the double-headed arrow 15. The rotational and transverse movement is intended to reduce variability in material removal rates over the surface of the wafer 12. The apparatus further comprises a rotating platen 16 on which is mounted a polishing pad 17. Typically the platen 16 causes the pad 17 to be rotated in a direction which is opposite to the direction of rotation of the wafer 12. The platen 16 is relatively large in comparison to the wafer 12, so that during the CMP process, the wafer 12 may be moved across the surface of the polishing pad 17 by the wafer carrier 11. A polishing slurry containing chemically reactive solution, in which are suspended abrasive particles, is deposited through a supply tube 18 onto the surface of the polishing pad 17. In use, the wafer 12 is pressed against the surface of the polishing pad 17 by an applied force F, typically measured in terms of a pressure on the semiconductor wafer in pounds-per-square-inch (PSI).

Polishing pads of varying hardness or compressibility are available for chemical-mechanical polishing processes. According to the preferred embodiment of the present invention, a relatively hard polishing pad (relatively low compressibility) is preferred for a first polishing step in order to achieve planarity of the semiconductor wafer surface. The polishing pad used for the first polishing step may comprise, for example, a pad of about 20" to 22" in diameter, constructed from polyurethane and having a compressibility in the range 0.5 to 6.0 percent. In the currently preferred embodiment of the invented process, a polyurethane pad manufactured by Rodel, Inc., known by the name IC-1000 is employed. In the first polishing step, the semiconductor wafer is polished on the relatively hard polishing pad using a slurry having a chemical reagent and a suspension of abrasive particles, in order to abrade surface material from the wafer. The wafer is polished to remove sufficient surface material (typically several thousand angstroms) to create a substantially planar surface on the wafer. In order to achieve this planarization, the pressure used to apply the wafer to the polishing pad is relatively highs and pressures in the range of about 3.5 PSI to about 9 PSI have been found to be appropriate. A polishing time in the range of about one minute to about four minutes is typically suitable for the first polishing step, although the polishing time is of course dependent upon the desired amount of material to be removed from the wafer surface. In the preferred embodiment, rotation speeds for the polishing pad and the wafer in the range of about 10 RPM to about 20 RPM are utilized.

During the first polishing step, an abrasive chemically reactive slurry is deposited onto the rotating polishing. The slurry used in the preferred embodiment comprises an aqueous solution of potassium hydroxide (KOH) having a pH in the range of approximately ten to eleven, and a colloidal suspension of silica particles of about five percent to twenty percent by weight. In the presently preferred process, the slurry utilized has a pH in the range of 10.2 to 10.7, and a suspension of silica particles in the range twelve percent to fifteen percent by weight.

Following the first polishing step, the process according to the preferred embodiment employs a second polishing step which is carried out on a different polishing pad. The polishing pad used for the second polishing step is a relatively soft pad (relatively high compressibility). A polishing pad constructed from a felt-like material, such as a Polytech Supreme polishing pad, is preferred for the second polishing step. A chemically reactive and abrasive slurry is also applied to the polishing pad used in the second polishing step, which can be the same type of slurry used in the first polishing step. The abrasive slurry combined with the relatively soft polishing pad in the second polishing step acts to smooth the surface of the semiconductor wafer, such as by removing or smoothing the edges of scratches formed in the wafer during the planarization thereof in the first polishing step. In the preferred embodiment, a pressure between the wafer and polishing pad during the second polishing step is in the range of about 2 PSI to about 5 PSI, with rotation speeds for the polishing pad and wafer again being about 10 RPM to 20 RPM. It has been found that longer polishing times for the second polishing step generally results in more effective scratch reduction. However, a polishing time for the second step in the range of about thirty to forty five seconds has been found to provide adequate reduction of surface scratches for some applications. In any event, it is preferred that the second polishing step be performed for at least thirty seconds.

A third polishing step is performed in accordance with the preferred process of the present invention, which utilizes the relatively soft polishing pad employed in the second polishing step. In the third polishing step, however, de-ionized water is applied to the polishing pad instead of the chemically reactive abrasive slurry. The third polishing step is used primarily for removing particles from the wafer surface, and the de-ionized water acts as a rinsing agent. Accordingly, the pressure between the wafer and polishing pad during the third polishing step is relatively light, such as between about 0.5 to 1.5 PSI. The third polishing step can be performed for any suitable length of time in order to remove debris from the wafer surface, although about one minute of the third polishing step has been found to generally be sufficient. Higher rotational speeds for the polishing pad and wafer are generally preferred for the third polishing step, as compared to the first and second polishing steps of the present invention. Higher rotational speeds can aid in the removal of particles from the surface of the wafer, as well as cleansing of the wafer of the remnants of the slurry used during the second polishing step. Rotational speeds for the wafer and polishing pad of greater than 30 RPM can be used for the third polishing step, for example.

The first polishing step in the planarization of the present invention is carried out according to conventional CMP principles, and therefore the particular parameters associated therewith can be adjusted by those of skill in the art to suit a particular application. The first polishing steps and the second and third polishing steps described herein above, are preferably carried out on conventional CMP apparatus, such as a Westech polishing apparatus. It is preferred that the first polishing step be performed on a separate polishing platen from the second and third polishing steps because, as will be apparent from the description above, the second and third polishing steps utilize a different polishing pad from the first polishing step. The second and third steps may be performed on the same platen, by merely adjusting the pressure on the wafer, the rotational speeds, and substituting the slurry for de-ionized water.

Figure 8:
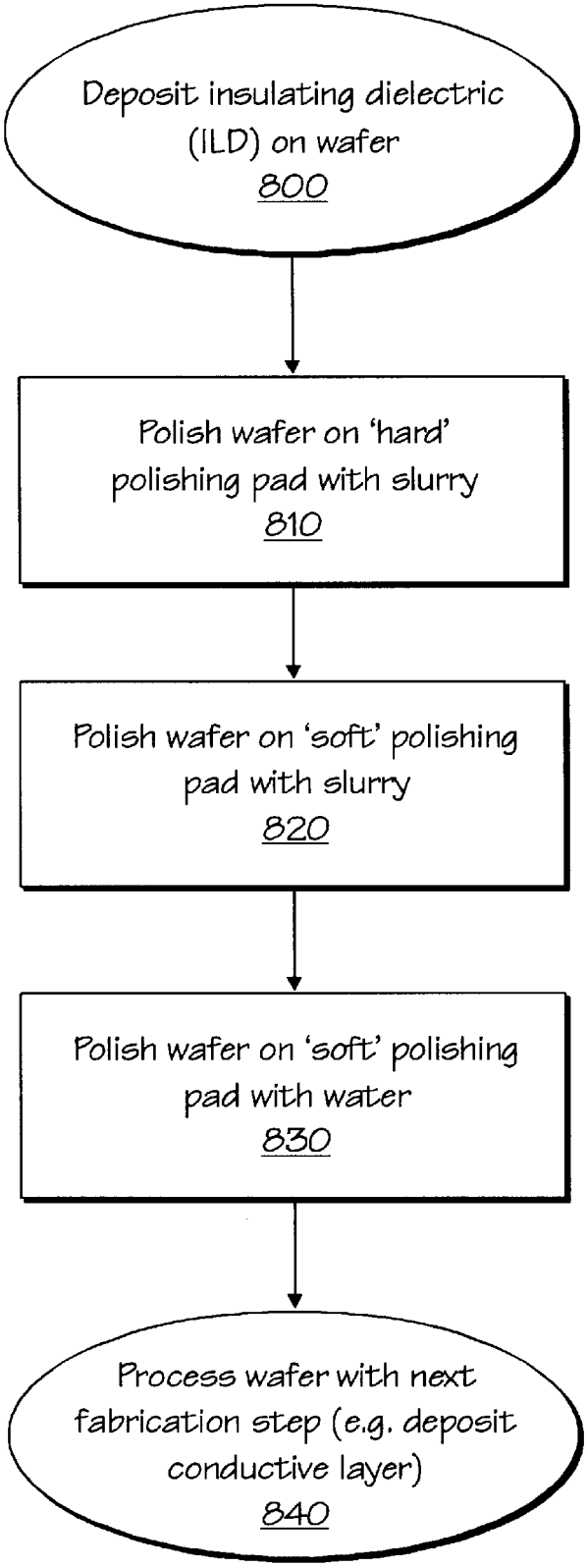
FIG. 8 is a flowchart showing an example of the method of the present invention.

FIG. 8 is a flowchart of steps performed in an example of the method of the present invention in a semiconductor integrated circuit fabrication process. Following the deposition of an insulating film (step 800), such as an interlayer dielectrics a first polishing step 810 is performed to planarize the surface of the ILD. The first polishing step is performed on a relatively hard polishing pad using a slurry. A second polishing step 820 is then performed to remove or reduce scratches on the ILD surface which may have been introduced during the first polishing step. The second polishing step is performed on a relatively soft polishing pad using a slurry. A third polishing step 830 follows, in which the wafer is polished on a relatively soft polishing pad using water, which aids in removing debris and remaining slurry from the surface of the wafer. Following the CMP steps, the wafer is prepared for the next fabrication process stage (step 840), such as depositing a conductive layer to form circuit interconnects.

The following is a detailed list of steps performed in a semiconductor wafer polishing process according to one preferred form of the invention. In this polishing process, the second and third polishing steps may in fact be performed using the same polishing pad on the same CMP apparatus, or may be performed with different pads such that the pad used for the third polishing step is not contaminated with the slurry used in the second polishing step.

1. First polishing step: Rodel IC-1000 polishing pad
   Platen (pad) speed: 13 RPM
   Carrier (wafer) speed: 12 RPM
   Pad-wafer pressure: 7 PSI
   Using slurry pH ~10.5, ~15% w/w silica
   Polishing time: ~1–4 minutes
2. Second polishing step: Polytech Supreme polishing pad
   Platen (pad) speed: 13 RPM
   Carrier (wafer) speed: 12 RPM
   Pad-wafer pressure : 3.5 PSI
   Using slurry pH ~10.5, ~15% w/w silica
   Polishing time: ~1 minute
3. Third polishing step: Polytech Supreme polishing pad
   Platen (pad) speed: 60 RPM
   Carrier (wafer) speed: 60 RPM
   Pad-wafer pressure: 1.0 PSI
   Using de-ionized water
   Polishing time: ~1 minute Although the preferred embodiment of the present invention has been described hereinabove in connection with various specific details, such as particular polishing pads, rotational speeds, pressures and the like, it will be appreciated by those skilled in the art of chemical-mechanical polishing of semiconductor wafers that these specific parameters need not be strictly adhered to in order to achieve the benefits of the present invention. Therefore, it is to be understood that the particular embodiment described above is presented by way of example only, and is in no way intended to be considered limiting to the extent of the invention. The reference to the details of the preferred embodiment is not intended to limit the scope of the appended claims, which themselves recite only those features regarded as essential to the invention.

What is claimed is:

1. A process for planarizing a layer on a substrate, comprising the steps of:

a first polishing step comprising polishing said layer on a first polishing pad;

a second polishing step comprising polishing said layer on a second polishing pad having a higher compressibility than said first polishing pad at an effective pressure to reduce scratches in said layer; and a third rising step comprising rinsing said layer on said second polishing pad using water.

2. A process as claimed in claim 1, wherein the compressibility of said second polishing pad is substantially greater than the compressibility of said first polishing pad.

3. The process as claimed in claim 1 wherein the first polishing step is performed using a first slurry and the second polishing step is performed using a second slurry.

4. The process as claimed in claim 3, wherein the slurry used in said first and second polishing steps comprises an aqueous solution having a pH in the range of 10 to 11.

5. The process as claimed in claim 4, wherein the slurry used in said first and second polishing steps comprises an aqueous solution having a pH in the range of 10.2 to 10.7.

6. The process as claimed in claim 4, wherein the slurry used in said first and second polishing steps further comprises silica or silica oxide particles in the range of about 5% to 20% by weight.

7. The process as claimed in claim 6, wherein the slurry used in said first and second polishing steps further comprises silica or silica oxide particles substantially in the range of 12% to 15% by weight.

8. A process as claimed in claim 2, wherein said first polishing pad is constructed from blown polyurethane and said second polishing pad comprises a felt-like material.

9. The process as claimed in claim 1, wherein said first polishing step comprises applying a surface of said layer to a surface of said first polishing pad with a pressure substantially in the range 3.5 to 9 pounds-per-square-inch (PSI).

10. The process as claimed in claim 9, wherein said first polishing step includes rotating each of said substrate and said first polishing pad at a speed of up to 30 revolutions-per-minute (RPM).

11. The process as claimed in claim 10, wherein said first polishing step comprises applying said layer to said first polishing pad with a pressure of about 7 PSI and rotating said substrate and said first polishing pad at about 12 RPM and 13 RPM, respectively.

12. A process as claimed in claim 11, wherein said first polishing step is carried out for a period of between about one minute and about four minutes.

13. The process as claimed in claim 1, wherein said second polishing step comprises applying a surface of said layer to a surface of said second polishing pad with a pressure substantially in the range of about 2 to 5 pounds-per-square-inch (PSI).

14. The process as claimed in claim 13, wherein said second polishing step comprises applying said layer to said second polishing pad with a pressure of about 3.5 PSI and rotating said substrate and said second polishing pad at about 12 RPM and 13 RPM, respectively.

15. A process as claimed in claim 14, wherein said second polishing step is carried out for at least 30 seconds.

16. The process as claimed in claim 1, wherein said third rinsing step comprises applying a surface of said layer to a surface of said second polishing pad with a pressure in the range of about 0.5 to 1.5 pounds-per-square-inch (PSI).

17. The process as claimed in claim 16, wherein said third rinsing step comprises applying said layer to said second polishing pad with a pressure substantially in the range 0.7 to 1.0 PSI and rotating each of said substrate and said second polishing pad greater than about 30 RPM.

18. The process as claimed in claim 3 wherein the first and second slurries are the same.

19. The process as claimed in claim 1, wherein said second and third polishing steps are performed by applying a surface of said layer to a surface of said second polishing pad and rotating both said substrate and said second polishing pad relative to one another, wherein the rotation of said substrate and said second polishing pad during said third rinsing step is at substantially higher rotational rates than during said second polishing step.

20. The process as claimed in claim 1, wherein the first polishing step is conducted at a pressure of from about 7.0 to 9.0 PSI.

21. The process as claimed in claim 9, wherein said effective pressure in said second polishing step is substantially in the range of about 2 to 5 PSI.

22. A process for planarizing a layer on a substrate, comprising the steps of:

a first polishing step comprising polishing said layer on a first polishing pad using a first slurry;

a second polishing step comprising polishing said layer on a second polishing pad having a higher compressibility than said first polishing pad using a second slurry at a pressure effective to remove or reduce scratches in said layer; and a third rinsing step comprising rinsing said wafer on a soft polishing pad using water.

23. A process as claimed in claim 22, wherein said soft polishing pad for said third polishing step comprises said second polishing pad.

24. The process as claimed in claim 23, wherein said second polishing step and third rinsing step are performed by applying a surface of said layer to a surface of said second polishing pad and rotating both said substrate and said second polishing pad relative to one another, wherein the rotation of said substrate and said second polishing pad during said third rinsing step is at substantially higher rotational rates than during said second polishing step.

25. A substrate having a layer planarized by a process comprising the following steps:

a first polishing step comprising polishing said layer on a first polishing pad using a first slurry having a first polishing reagent;

a second polishing step comprising polishing said layer on a second polishing pad having a higher compressibility than said first polishing pad using a second slurry, at a pressure effective to reduce scratches in said layer; and a third rinsing step comprising rinsing said layer on said second polishing pad using water.

* * * * *